US007513768B2

(12) United States Patent
Porter et al.

(10) Patent No.: US 7,513,768 B2
(45) **Date of Patent: *Apr. 7, 2009**

(54) EMBEDMENT ROLL DEVICE

(75) Inventors: Michael J. Porter, Akron, IN (US); William A. Frank, Lake Villa, IL (US); Lloyd George, West Bay (CA); Eugene Scott Stivender, Elkhorn, WI (US); Alfredas Blyskis, Oak Lawn, IL (US)

(73) Assignee: United States Gypsum Company, Chicago, IL (US)

( * ) Notice: Subject to any disclaimer, the term of this patent is extended or adjusted under 35 U.S.C. 154(b) by 203 days.

This patent is subject to a terminal disclaimer.

(21) Appl. No.: 11/591,957

(22) Filed: Nov. 1, 2006

(65) Prior Publication Data

US 2007/0110838 A1 May 17, 2007

Related U.S. Application Data

(63) Continuation-in-part of application No. 10/665,541, filed on Sep. 18, 2003, now Pat. No. 7,182,589.

(51) Int. Cl.
*B28B 3/12* (2006.01)

(52) U.S. Cl. ..... 425/335; 425/115; 425/373

(58) Field of Classification Search ..... 425/115, 425/335, 336, 373, 403, 385; 264/112, 113
See application file for complete search history.

(56) References Cited

U.S. PATENT DOCUMENTS

| | | | | |
|---|---|---|---|---|
| 2,446,644 | A | 8/1948 | Fischer | |
| 2,655,978 | A | 10/1953 | Gonda et al. | |
| 3,115,431 | A * | 12/1963 | Stokes et al. | 264/113 |
| 3,214,311 | A | 10/1965 | Schwab et al. | |
| 3,289,371 | A | 12/1966 | Pearson et al. | |
| 3,615,979 | A | 10/1971 | Davis et al. | |
| 3,901,634 | A | 8/1975 | Webb et al. | |
| 3,972,972 | A | 8/1976 | Yano et al. | |
| 4,068,991 | A * | 1/1978 | Ufermann et al. | 425/81.1 |
| 4,203,788 | A | 5/1980 | Clear | |
| 4,420,295 | A | 12/1983 | Clear et al. | |
| 4,504,335 | A | 3/1985 | Galer | |
| 4,514,090 | A | 4/1985 | Neubauer et al. | |
| 4,666,029 | A * | 5/1987 | Burkner | 198/382 |
| 4,778,718 | A | 10/1988 | Nicholls | |
| 5,020,916 | A | 6/1991 | Fritsch | |

(Continued)

FOREIGN PATENT DOCUMENTS

| | | |
|---|---|---|
| DE | 126 6198 | 4/1968 |

*Primary Examiner*—Yogendra Gupta
*Assistant Examiner*—Maria Veronica D Ewald
(74) *Attorney, Agent, or Firm*—Greer, Burns & Crain, Ltd; David F. Janci, Esq.; Pradip Sahu, Esq.

(57) ABSTRACT

An embedment device includes a first integrally formed elongate shaft rotatably secured to the support frame and having a first plurality of axially spaced disks axially fixed to the first shaft, a second integrally formed elongate shaft rotatably secured to the support frame and having a second plurality of axially spaced disks axially fixed to the second shaft, the first shaft being disposed relative to the second shaft to be horizontally aligned and so that the disks intermesh with each other, and wherein, when viewed from the side, peripheries of the first and second pluralities of disks overlap each other.

16 Claims, 5 Drawing Sheets

U.S. PATENT DOCUMENTS

| | | | |
|---|---|---|---|
| 5,325,954 | A | 7/1994 | Crittenden et al. |
| 5,340,518 | A | 8/1994 | Paul |
| 5,685,903 | A | 11/1997 | Stav et al. |
| 5,858,083 | A | 1/1999 | Stav et al. |
| 5,958,131 | A | 9/1999 | Asbridge et al. |
| 5,961,900 | A | 10/1999 | Wedi |
| 6,176,920 | B1 | 1/2001 | Murphy et al. |
| 2001/0000738 | A1 | 5/2001 | Mathieu |
| 2004/0084127 | A1 | 5/2004 | Porter |
| 2004/0218462 | A1 | 11/2004 | Stephens |
| 2004/0231916 | A1 | 11/2004 | Englert et al. |
| 2005/0061237 | A1 | 3/2005 | Dubey et al. |
| 2005/0064055 | A1 | 3/2005 | Porter |
| 2005/0064164 | A1 | 3/2005 | Dubey et al. |
| 2005/0121131 | A1 | 6/2005 | Hennis et al. |
| 2005/0155689 | A1 | 7/2005 | Smolenski |
| 2005/0219941 | A1 | 10/2005 | Christenson et al. |
| 2006/0147681 | A1 | 7/2006 | Dubey |
| 2006/0168906 | A1 | 8/2006 | Tonyan et al. |
| 2006/0174572 | A1 | 8/2006 | Tonyan et al. |

* cited by examiner

20
T
40
34
22
42
24
32

30
36

R
38

48
50
16
46
44
52

EMBEDMENT ROLL DEVICE

CROSS REFERENCE TO RELATED APPLICATIONS

This application is a continuation-in-part of application U.S. Ser. No. 10/665,541, now U.S. Pat. No. 7,182,589, entitled EMBEDMENT DEVICE FOR FIBER-ENHANCED SLURRY, filed Sep. 18, 2003, and is related to co-pending application U.S. Ser. No. 11/591,793 entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT U.S. Ser. No. 11/555,647, entitled PROCESS AND APPARATUS FOR FEEDING CEMENTITIOUS SLURRY FOR FIBER-REINFORCED STRUCTURAL CEMENT PANELS; U.S. Ser. No. 11/555,655, entitled METHOD FOR WET MIXING CEMENTITIOUS SLURRY FOR FIBER-REINFORCED STRUCTURAL CEMENT PANELS, filed concurrently with the present application; U.S Ser. No. 11/555,661, entitled PANEL SMOOTHING PROCESS AND APPARATUS FOR FORMING A SMOOTH CONTINUOUS SURFACE ON FIBER-REINFORCED STRUCTURAL CEMENT PANELS, filed concurrently with the present application; and U.S. Ser. No. 11/555,665 entitled WET SLURRY THICKNESS GAUGE AND METHOD FOR USE OF SAME, filed concurrently with the present application; and all herein incorporated by reference.

FIELD OF THE INVENTION

The present embedment roll device relates generally to devices for embedding fibers in settable slurries, and specifically to a device designed for embedding fibers in a settable cement slurry along a cement board or cementitious structural panel ("SCP") production line.

Cementitious panels have been used in the construction industry to form the interior and exterior walls of residential and/or commercial structures. The advantages of such panels include resistance to moisture compared to standard gypsum-based wallboard. However, a drawback of such conventional panels is that they do not have sufficient structural strength to the extent that such panels may be comparable to, if not stronger than, structural plywood or oriented strand board (OSB).

Typically, the cementitious panel includes at least one hardened cement or plaster composite layer between layers of a reinforcing or stabilizing material. In some instances, the reinforcing or stabilizing material is fiberglass mesh or the equivalent. The mesh is usually applied from a roll in sheet fashion upon or between layers of settable slurry. Examples of production techniques used in conventional cementitious panels are provided in U.S. Pat. Nos. 4,420,295; 4,504,335 and 6,176,920, the contents of which are incorporated by reference herein. Further, other gypsum-cement compositions are disclosed generally in U.S. Pat. Nos. 5,685,903; 5,858,083 and 5,958,131.

One drawback of conventional processes for producing cementitious panels is that the fibers, applied in a mat or web, are not properly and uniformly distributed in the slurry, and as such, the reinforcing properties resulting due to the fiber-matrix interaction vary through the thickness of the board, depending on the thickness of each board layer. When insufficient penetration of the slurry through the fiber network occurs, poor bonding between the fibers and the matrix results, causing low panel strength. Also, in some cases when distinct layering of slurry and fibers occurs, improper bonding and inefficient distribution of fibers causes poor panel strength development.

Another drawback of conventional processes for producing cementitious panels is that the resulting product is too costly and as such is not competitive with outdoor/structural plywood or oriented strand board (OSB).

One source of the relatively high cost of conventional cementitious panels is due to production line downtime caused by premature setting of the slurry, especially in particles or clumps which impair the appearance of the resulting board, and interfere with the efficiency of production equipment. Significant buildups of prematurely set slurry on production equipment require shutdowns of the production line, thus increasing the ultimate board cost.

In instances, such as disclosed in commonly-assigned Ser. No. 10/666,294 entitled MULTI-LAYER PROCESS AND APPARATUS FOR PRODUCING HIGH STRENGTH FIBER-REINFORCED STRUCTURAL CEMENTITIOUS PANELS (U.S. Pub. No. 2005-0064164A1), where loose chopped fiberglass fibers are mixed with the slurry to provide a cementitious structural panel (SCP) having structural reinforcement, the need arises for a way to thoroughly mix the fibers with the slurry. Such uniform mixing is important for achieving the desired structural strength of the resulting panel or board.

A design criteria of any device used to mix settable slurries of this type is that production of the board should continue uninterrupted during manufacturing runs. Any shutdowns of the production line due to the cleaning of equipment should be avoided. This is a particular problem when quick-setting slurries are created, as when fast setting agents or accelerators are introduced into the slurry.

A potential problem when creating cement structural panels in a moving production line, is for portions of the slurry to prematurely set, forming blocks or chunks of various sizes. When these chunks break free and become incorporated into the final board product, they interfere with the uniform appearance of the board, and also cause structural weaknesses. In conventional structural cement panel production lines, the entire production line must be shut down to clean clogged equipment to avoid the incorporation of prematurely set slurry particles into the resulting board.

Another design criteria of devices used to mix chopped reinforcing fibers into a slurry is that the fibers need to be mixed into the relatively thick slurry in a substantially uniform manner to provide the required strength.

Thus, there is a need for an improved device for thoroughly mixing fiberglass or other structural reinforcing fibers into a settable slurry so that the device does not become clogged or impaired by chunks or setting slurry.

BRIEF DESCRIPTION OF THE INVENTION

The above-listed needs are met or exceeded by the present embedment device including at least a pair of elongate shafts disposed on the fiber-enhanced settable slurry board production line to traverse the line. The shafts are preferably disposed in spaced parallel relation to each other. Each shaft has a plurality of axially spaced disks along the shaft. During board production, the shafts and the disks rotate axially. The respective disks of the adjacent, preferably parallel shafts are intermeshed with each other for creating a "kneading" or "massaging" action in the slurry, which embeds previously deposited fibers into the slurry so that the fibers are distributed throughout the slurry. In addition, the close, intermeshed and rotating relationship of the disks prevents the buildup of slurry on the disks, and in effect creates a "self-cleaning" action which significantly reduces board line downtime due to premature setting of clumps of slurry.

More specifically, an embedment device is provided including a first integrally formed elongate shaft rotatably secured to the support frame and having a first plurality of axially spaced disks axially fixed to the first shaft, a second integrally formed elongate shaft rotatably secured to the support frame and having a second plurality of axially spaced disks axially fixed to the second shaft, the first shaft being disposed relative to the second shaft to be horizontally aligned and so that the disks intermesh with each other, and wherein, when viewed from the side, peripheries of the first and second pluralities of disks overlap each other.

In another embodiment, an embedment device is provided including a first roll secured to the support frame including a first shaft and a first plurality of axially spaced disks, a second roll secured to the support frame including a second shaft and a second plurality of axially spaced disks, the first roll and the second roll arranged on the support frame such that the first plurality of axially spaced disks and the second plurality of axially spaced disks intermesh with each other approximately twice a distance of embedment of the disks into the slurry.

In yet another embodiment, an embedment device is provided including a first roll rotatably secured to the support frame including a first shaft and a first plurality of axially spaced disks axially fixed to the first shaft, a second roll rotatably secured to the support frame including a second shaft and a second plurality of axially spaced disks axially fixed to the second shaft, the first roll being disposed relative to the second roll to be horizontally aligned and so that the first plurality of axially spaced disks and the second plurality of axially spaced disks intermesh with each other approximately twice a distance of embedment of the disks into the slurry, wherein a clearance between adjacent intermeshed disks of the first plurality of axially spaced disks and the second plurality of axially spaced disks is less than a diameter of a sample fiber bundle of the chopped fiber bundle.

DETAILED DESCRIPTION OF THE INVENTION

Figure 1:
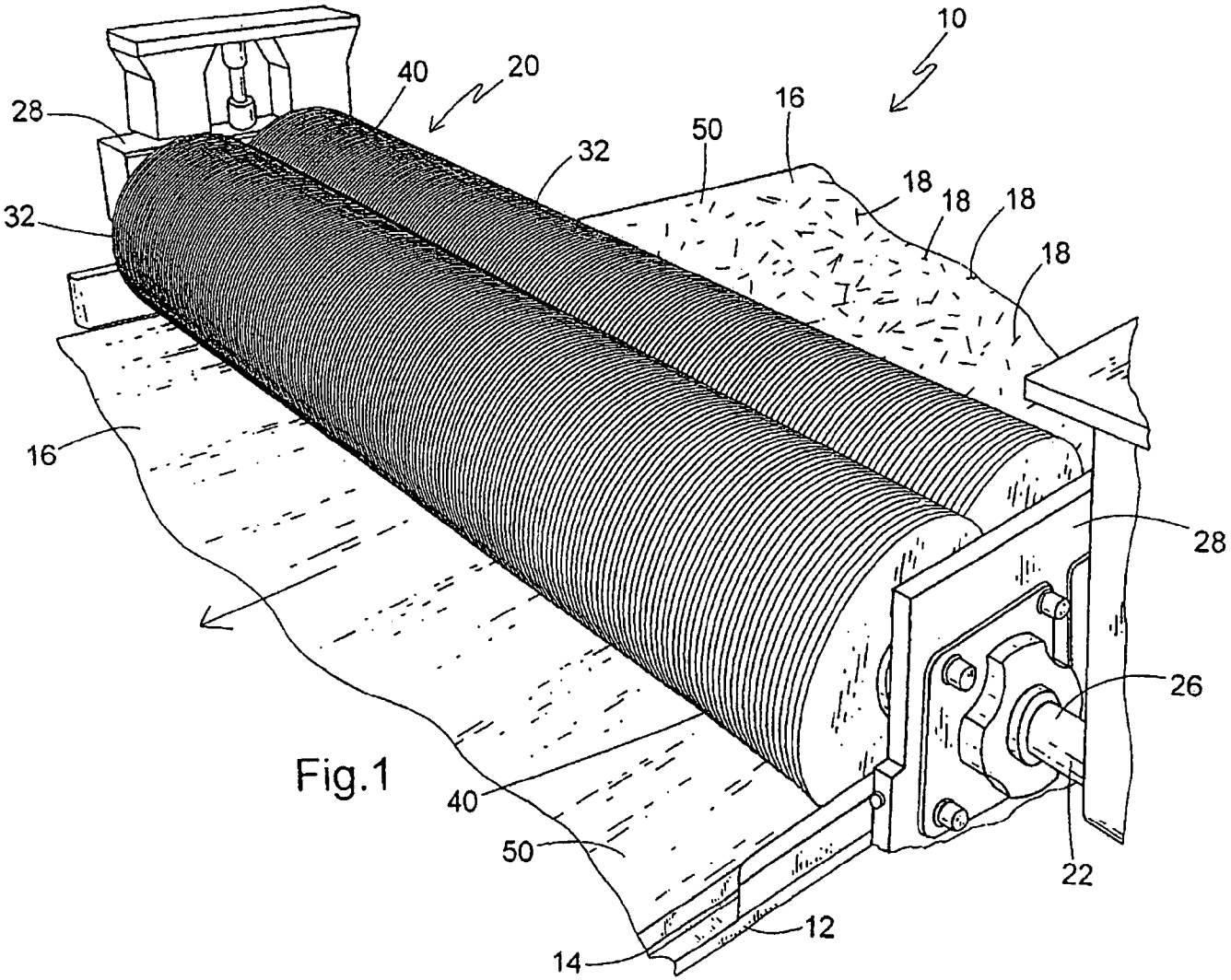
FIG. 1 is a top perspective view of a first embodiment of the present embedment device on a structural slurry board production line.
Figures 2, 3, 4:
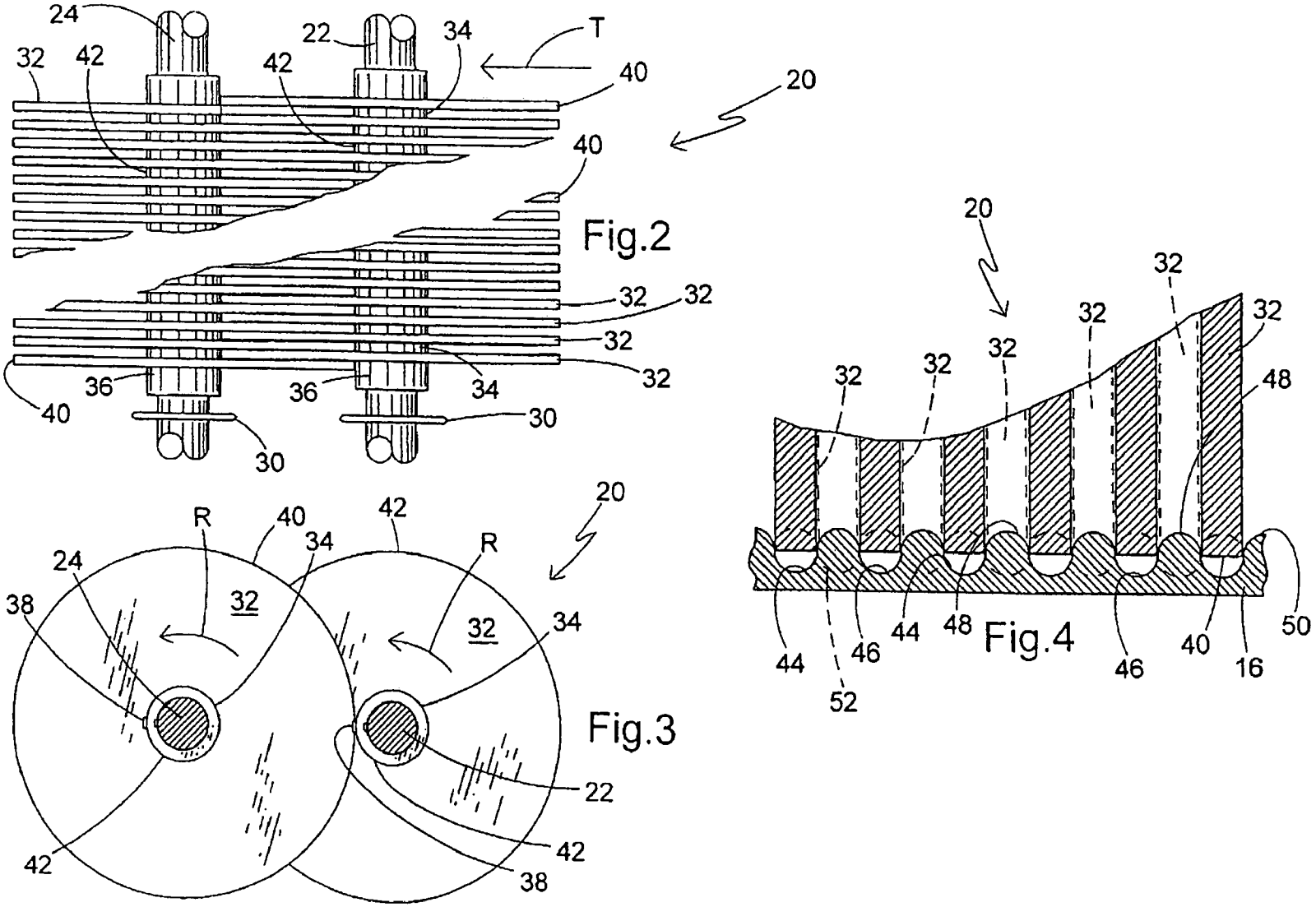
FIG. 2 is a fragmentary overhead plan view of the embedment device of FIG. 1.
FIG. 3 is a side elevation of the embedment device of FIG. 2.
FIG. 4 is a schematic diagram of the patterns of embedment tracks/troughs created in the slurry by the present embedment device.

Referring now to FIGS. 1 and 2, a structural panel production line is fragmentarily shown and is generally designated 10. The production line 10 includes a support frame or forming table 12 which supports a moving carrier 14, such as a rubber-like conveyor belt, a web of craft paper, release paper, and/or other webs of support material designed for supporting a slurry prior to setting, as is well known in the art. The carrier 14 is moved along the support frame 12 by a combination of motors, pulleys, belts or chains and rollers (none shown) which are also well known in the art. Also, while the present invention is intended for use in producing structural cement panels, it is contemplated that it may find application in any situation in which bulk fibers are to be mixed into a settable slurry for board or panel production.

While other sequences are contemplated depending on the application, in the present invention, a layer of slurry 16 is deposited upon the moving carrier web 14 to form a uniform slurry web. While a variety of settable slurries are contemplated, the present embedment device is particularly designed for use in producing structural cement panels. As such, the slurry is preferably made up of varying amounts of Portland cement, gypsum, aggregate, water, accelerators, plasticizers, foaming agents, fillers and/or other ingredients well known in the art. The relative amounts of these ingredients, including the elimination of some of the above or the addition of others, may vary to suit the application. A supply or bundle of chopped fibers 18, which in the preferred embodiment are chopped fiberglass fibers, are dropped or sprinkled upon the moving slurry web 16.

As described in further detail in co-pending and commonly owned U.S. Ser. No. 11/591,793 entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT, herein incorporated by reference, it is preferred that two applications of chopped fibers 18 are utilized for each layer of slurry 16 to provide additional structural reinforcement. Further, a vibrator (not shown) is optionally located in operational proximity to the moving carrier 14 to vibrate the slurry 16 and more uniformly embed the fibers 18 as they are deposited upon the slurry.

The present embedment device, generally designated 20, is disposed on the support frame 12 to be just "downstream" or after the point at which the fibers 18 are deposited upon the slurry web 16. Included in the device 20 are at least two elongate shafts 22, 24 each having ends 26 engaged in a bracket 28 located on each side of the support frame 12. Although two shafts 22, 24 are depicted, additional shafts may be provided if desired. One set of shaft ends 26 is preferably provided with toothed sprockets or pulleys 30 (best seen in FIG. 2) or other driving mechanism to enable the shafts 22, 24 to be axially rotated in the brackets 28. It is preferred that the shafts 22, 24, and the associated disks 32, 34, are rotated in the same direction. Motorized belt drives, chain drives or other typical systems for driving rollers or shafts along a production line are considered suitable here. It will be seen that the shafts 22, 24 are mounted generally transversely on the support frame 12, and are in spaced, generally parallel relationship to each other. In the preferred embodiment, the shafts 22, 24 are parallel to each other.

Each of the shafts 22, 24 is provided with a plurality of axially spaced main or relatively large disks 32, with adjacent disks being axially spaced from each other. The spacing is maintained by a second plurality of relatively smaller diameter spacer disks 34 (FIG. 2) which are each located between an adjacent pair of main disks 32. As is seen in FIG. 3, it is preferred that at least the main disks 32, and preferably both the main and the spacer disks 32, 34 are keyed to the respective shaft 22, 24 for common rotation. The toothed sprockets 30 are also preferably keyed or otherwise secured to the shafts 22, 24 for common rotation. In the preferred embodiment, keyed collars 36 (best seen in FIG. 3) located adjacent each shaft end 26 are secured to the shaft, as by set keys or set screws 38 and retain the disks 32, 34 on the shafts 22, 24 against lateral movement.

It will also be seen from FIGS. 1-3 that the disks 32, 34 of the respective shafts 22, 24 are intermeshed with each other, so that the main disks 32 of the shaft 22 are located between disks 32 of the shaft 24. It will also be seen that, upon becoming intermeshed, peripheral edges 40 of the main disks 32 overlap each other, and are disposed to be in close, yet rotational relationship to peripheral edges 42 of the opposing spacer disks 34 of the opposing shaft (best seen in FIG. 3). It is preferred that the shafts 22, 24, and the associated disks 32, 34, are rotated in the same direction 'R' (FIG. 3).

While the relative dimensions of the disks, 32, 34 may vary to suit the application, in the preferred embodiment, the main disks 32 are ¼" (0.64 cm) thick and are spaced 5/16" (0.79 cm) apart. Thus, there is a close, yet relatively rotational tolerance created when the adjacent disks 32 of the shafts, 22, 24 intermesh with each other (best seen in FIG. 2). This close tolerance makes it difficult for particles of the settable slurry 16 to become caught between the disks 32, 34 and set prematurely. Also, since the shafts 22, 24, and the associated disks 32, 34 are constantly moving during SCP panel production, any slurry which is caught between the disks is quickly ejected, and has no chance to set in a way which would impair the embedment operation. It is also preferred that the peripheries of the disks 32, 34 are flattened or perpendicular to the plane of the disk, but it is also contemplated that tapered or otherwise angled peripheral edges 40, 42 could be provided and still achieve satisfactory fiber embedment.

The self-cleaning property of the present embedment device 20 is further enhanced by the materials used for the construction of the shafts 22, 24 and the disks 32, 34. In the preferred embodiment, these components are made of stainless steel which has been polished to obtain a relatively smooth surface. Also, stainless steel is preferred for its durability and corrosion resistance, however other durable, corrosion resistant and non-stick materials are contemplated, including Plexiglas material or other engineered plastic materials.

Further, the height of the shafts 22, 24 relative to the moving web 14 is preferably adjustable to promote embedment of the fibers 18 into the slurry 16. It is preferred that the disks 32 not contact the carrier web 14, but extend sufficiently into the slurry 16 to promote embedment of the fibers 18 into the slurry. The specific height of the shafts 22, 24 above the carrier web 14 may vary to suit the application, and will be influenced, among other things, by the diameter of the main disks 32, the viscosity of the slurry, the thickness of the slurry layer 16 and the desired degree of embedment of the fibers 18.

Referring now to FIG. 4, the plurality of main disks 32 on the first shaft 22 are disposed relative to the frame 12 to create a first trough pattern 44 (solid lines) in the slurry 16 for embedding the fibers 18 therein. The trough pattern 44 includes a series of valleys 46 created by the disks 32 and hills 48 located between the disks as the slurry 16 is pushed to the sides of each disk. Since the fibers 18 have been immediately previously deposited upon an upper surface 50 of the slurry 16, a certain percentage of the fibers will become mixed into the slurry through the formation of the first trough pattern 44. It will be appreciated that as the shafts 22, 24 are rotating and turning the associated disks 32, 34, the carrier web or belt 14 is also moving in a direction of travel 'T' (FIG. 2) from the first shaft 22 to the second shaft 24. In this manner, a churning dynamic movement is also created which will enhance the embedment of the fibers 18.

Immediately after leaving the vicinity of the disks 32 of the first shaft 22, the slurry 16 encounters the disks 32 of the second shaft 24 (shown in phantom), which proceed to create a second trough pattern 52. Due to the laterally offset position of the disks 32 of the respective shafts 22, 24, at any selected point, the second trough pattern 52 is opposite to the pattern 44, in that hills 54 replace the valleys 46, and valleys 56 replace the hills 48. In that the trough patterns 44, 52 generally resemble sinusoidal waves, it may also be stated that the trough patterns 44, 52 are out of phase relative to each other. This transversely offset trough pattern 52 further churns the slurry 16, enhancing the embedment of the fibers 18. In other words, a slurry massaging or kneading action is created by the rotation of the intermeshed disks 32 of the shafts 22, 24.

Figure 5:
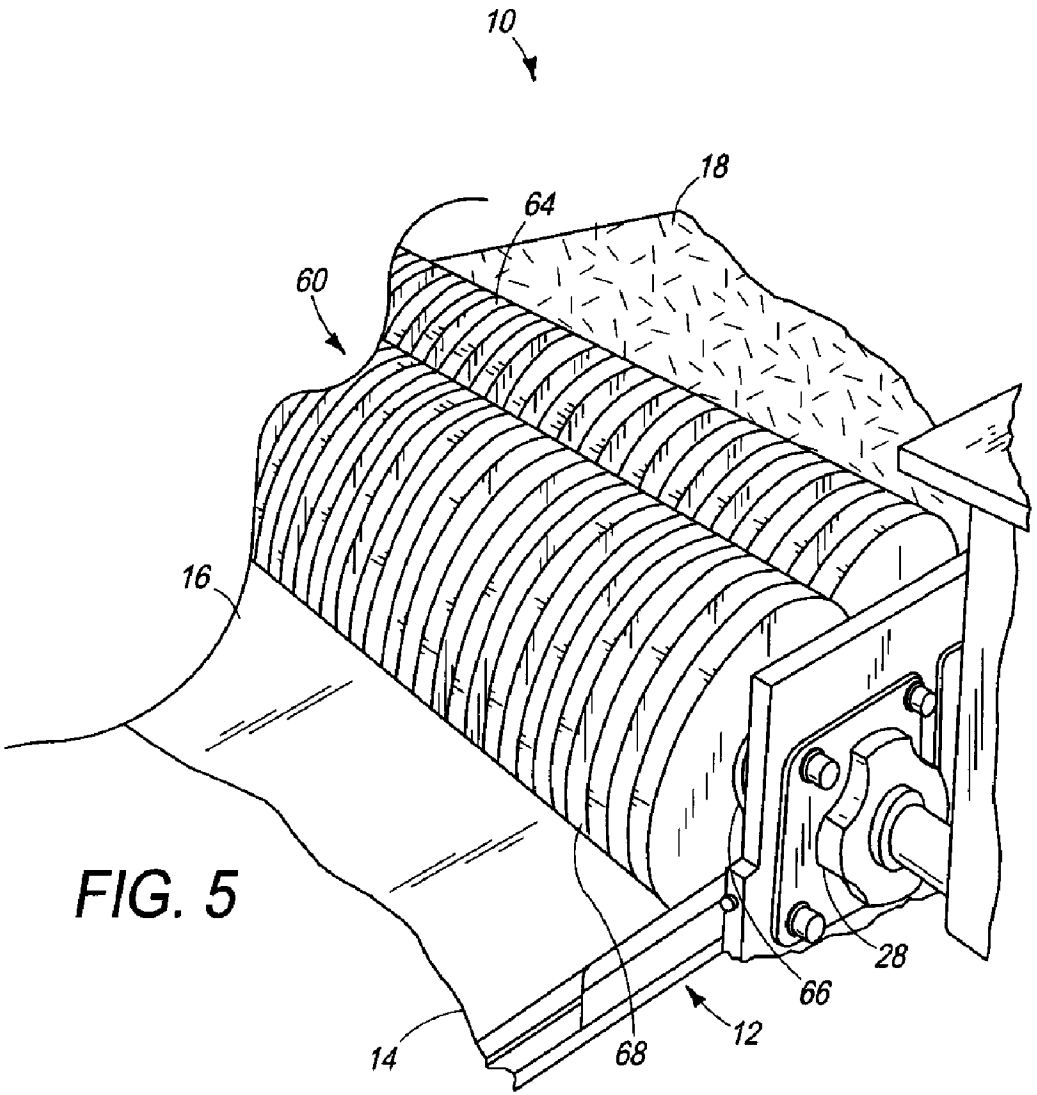
FIG. 5 is a top perspective view of an alternate embodiment of the present embedment device on a structural slurry board production line.

During development of the embedment device 20, it was found that in some cases, individual fiber bundles can become lodged between rotating disks of the devices, expanding in diameter as they are rolled together with other fibers and causing the devices to lock up or stop. As a result, the entire SCP panel production line must generally be shut down to disassemble the embedment devices 20 and remove the lodged fibers from the disks, increasing the ultimate board cost and reducing the efficiency of the production line. Accordingly, an alternate embedment roll device 60 is provided and is illustrated in FIG. 5. Components used in the device 60 and shared with the device 20 of FIGS. 1-4 are designated with identical reference numbers, and the above description of those components is considered applicable here. Similarly, an applicable SCP panel production line is described in co-pending and commonly owned U.S. Ser. No. 10/665,541 entitled EMBEDMENT DEVICE FOR FIBER-ENHANCED SLURRY, filed Sep. 18, 2003, and is related to application U.S. Ser. No. 10/665,541, now U.S. Pat. No. 7,182,589, entitled EMBEDMENT DEVICE FOR FIBER-ENHANCED SLURRY, filed Sep. 18, 2003, and is related to co-pending application U.S. Ser. No. 11/591,793 entitled MULTI-LAYER PROCESS AND APPARATUS FOR PRODUCING HIGH STRENGTH FIBER-REINFORCED STRUCTURAL CEMENTITIOUS PANELS WITH ENHANCED FIBER CONTENT; U.S. Ser. No. 11/555,647, entitled PROCESS AND APPARATUS FOR FEEDING CEMENTITIOUS SLURRY FOR FIBER-REINFORCED STRUCTURAL CEMENT PANELS; U.S. Ser. No. 11/555,655, entitled METHOD FOR WET MIXING CEMENTITIOUS SLURRY FOR FIBER-REINFORCED STRUCTURAL CEMENT PANELS, filed concurrently with the present application; U.S. Ser. No. 11/555,661, entitled PANEL SMOOTHING PROCESS AND APPARATUS FOR FORMING A SMOOTH CONTINUOUS SURFACE ON FIBER-REINFORCED STRUCTURAL CEMENT PANELS, filed concurrently with the present application; and U.S. Ser. No. 11/555,665 entitled WET SLURRY THICKNESS GAUGE AND METHOD FOR USE OF SAME, filed concurrently with the present application; and all herein incorporated by reference.

Similar to the embedment device 20, the embedment device 60 is rotatably disposed on the support frame 12 just "downstream" of where the fibers 18 are deposited upon the slurry web 16. As discussed in the above described process application, it is contemplated that an embedment device 60 is provided for each slurry layer used to create an SCP panel. The device 60 includes a first integrally formed elongate shaft 62 secured to the support frame 12 and has a first plurality of axially spaced disks 64 axially fixed to the first shaft, and a second integrally formed elongate shaft 66 secured to the support frame and having a second plurality of axially spaced disks 68 axially fixed to the second shaft.

The embedment device 20 includes disks having a thickness of less than ½ inch (1.27 cm) to provide a greater number of disks on each shaft and to more uniformly embed the fibers 18 into the slurry 16. However, in the course of development of the embedment device 60, it was found that by increasing the thickness of the disks 64, 68 and decreasing the number of disks by approximately one-half, friction between the disks was reduced by half, while still providing uniform embedment. Preferably, the thickness of the disks 64, 68 is approximately ½-1 inch (1.27-2.54 cm), although this range may vary to suit the application. It is contemplated that reducing the friction between adjacent disks 64, 68 will prevent jamming of the disks and reduction in rotational speed of the shafts 62, 66.

Similar to the embedment device 20, each of the shafts 62, 66 have ends 69 engaged in the bracket 28 located on each side of the support frame 12. It is preferred that the shafts 62, 66 and their associated disks 64, 68, are rotated in the same direction. Due to their resistance against slippage, motorized chain drives (not shown) are preferred for rotating the shafts 62, 66, although it is appreciated that other systems for driving the shafts may be suitable, as known in the art.

As seen in FIG. 5, the shafts 62, 66 are mounted generally transversely on the support frame 12 and are oriented on the frame to be generally parallel to each other, and define a plane vertically displaced from and parallel to the moving carrier 14.

As seen in FIG. 2, the large disks 32 of the embedment device 20 generally intermesh with each other to approximately the outer peripheral edge 42 of the spacer disks 34. However, it has been found that in some cases, fibers can become caught between the intermeshed disks, preventing rotation of the shafts and requiring production line shutdown.

Figure 7:
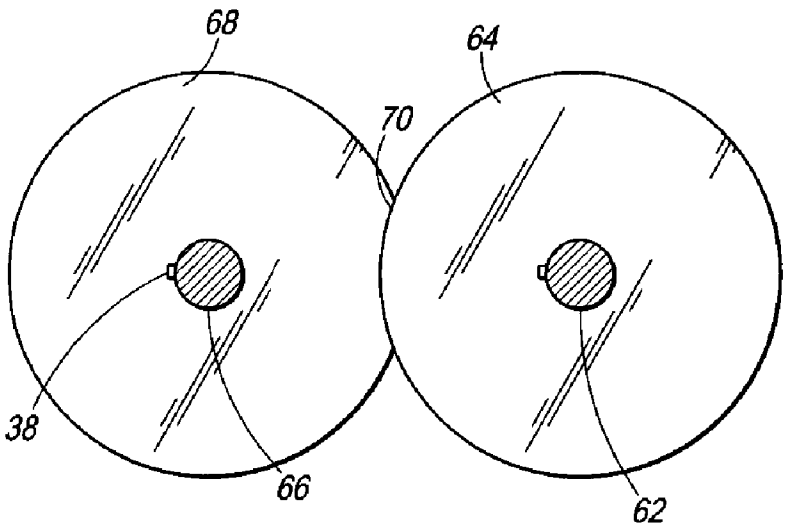
FIG. 7 is a side elevation view of the embedment device of FIG. 5.
Figure 6:
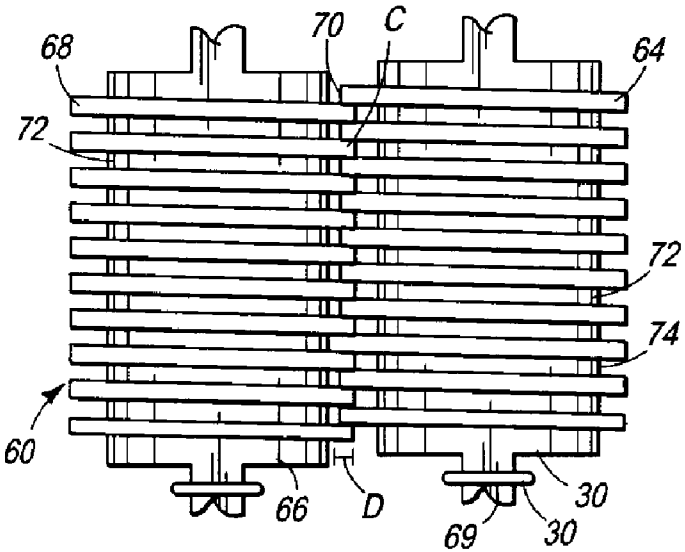
FIG. 6 is a fragmentary overhead plan view of a first disk configuration of the embedment device of FIG. 5.

Accordingly, in the embedment device 60 and as shown in FIGS. 6-7, the first plurality of axially spaced disks 64 and the second plurality of axially spaced disks 68 preferably intermesh with each other only in regions of their respective outer peripheral edges 70, or a distance approximately twice a distance "D" of embedment of the disks into the slurry 16. Preferably still, the first plurality of axially spaced disks 64 and the second plurality of axially spaced disks 68 intermesh with each other to create approximately ½ inch (1.27 cm) of overlap, although other distances may be appropriate, depending on the application. It is contemplated that this arrangement prevents jamming of the disks 64, 68 while still providing uniform embedment of the fibers 18 into the slurry 16.

To further prevent clogging between adjacent disks, a clearance "C" (FIG. 6) between adjacent intermeshed disks of the first plurality of axially spaced disks 64 and the second plurality of axially spaced disks 68 is preferably less than a diameter of a sample fiber of the chopped fibers 18. Preferably, the clearance "C" is approximately 0.01-0.018 inches (0.03-0.05 cm), although this range may vary to suit the application. It is contemplated that this arrangement prevents fibers 18 from jamming between adjacent disks during rotation, which can require shutdown of the entire production line 10 to disassemble the embedment device 60 and remove the jammed fibers. It is further contemplated that this configuration still provides a self-cleaning action by ejecting any fibers/slurry that might normally catch between the intermeshed disks 64, 68, due to the constant movement of the shafts 62, 66 during SCP panel production.

Best seen in FIG. 6, one embodiment of the embedment device 60 further includes a groove 72 defined between adjacent disks 64, 68 and integrally formed on the first and second shafts 62, 66. It is contemplated that by integrally forming the groove 72 and the disks 64, 68 on the shafts 62, 66, the clearance between adjacent intermeshed disks remains consistent after continued operation and provides a more uniform and efficient embedment. Since the shafts 62, 66 and the disks 64, 68 are integrally formed, the groove 72 is also an outer peripheral edge 74 of the shafts. Preferably, the groove 72 is approximately 1.4-1.8 inches (3.56-4.57 cm) deep, although it is appreciated that other ranges may be appropriate to suit the application.

It will be understood that in integrally forming the shafts 62, 66 to create the plurality of spaced disks 64, 68 separated by the grooves 72, each shaft is preferably fabricated by machining the grooves 72 into a solid cylindrical shaft. Thus, the disks 64, 68 will not be distinct from the grooves as one progresses towards the axis of the shaft radially inwardly from the groove 72. Nevertheless, since the shaft produced in this manner results in a plurality of spaced, circular, flat shapes which at their peripheries act like the disks 32 in the embedment device 20, they are also referred to as disks in reference to the device 60. Also, other fabrication techniques are contemplated for producing integrally formed shafts with disks 64, 68, including, but not limited to welding or otherwise integrally fastening individual components, or using chemical adhesives or the like.

Figure 8:
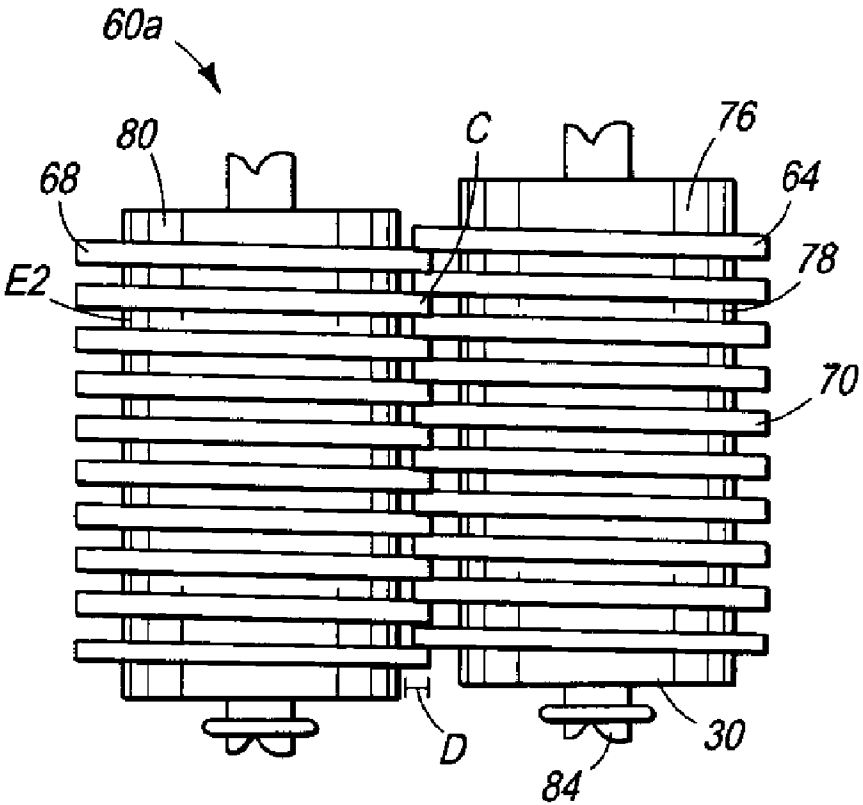
FIG. 8 is a fragmentary overhead plan view of another disk configuration of the embedment device of FIG. 5.

In another embodiment of the embedment device 60, generally designated 60*a* in FIG. 8, a first shaft 76 includes a first plurality of relatively small diameter disks 78 located between the first plurality of axially spaced disks 64, and a second shaft 80 includes a second plurality of relatively small diameter disks 82 located between the second plurality of axially spaced disks 68. The disks 78, 82 are individually formed and alternately placed between disks 64, 68 on the shafts 62, 66, respectively. Each of the shafts 62, 66 have ends 84 engaged in the bracket 28 located on each side of the support frame 12. One set of shaft ends 84 is preferably provided with toothed sprockets or pulleys 30 to enable rotation of the shafts. As described above in relation to FIG. 3, preferably both the main disks 64, 68 and the smaller disks 78, 82 are keyed to the respective shafts 76, 80 for common rotation. The toothed sprockets 30 are also preferably keyed to the respective shaft 76, 80 for common rotation.

Similar to the groove 72, the relatively small diameter disks 76, 78 are sized such that the intermesh between adjacent disks 64, 68 is only in the region of the disk outer peripheral edges 70. Due to the increased thickness of the disks 64, 68, it is contemplated that the arrangement of smaller diameter disks 76, 78 and disks 64, 68 will maintain a consistent clearance "C" between adjacent intermeshed disks during continued operation of the device 60.

Thus, the present embedment device provides a mechanism for incorporating or embedding chopped fiberglass fibers into a moving slurry layer. An important feature of the present device is that the disks of the respective shafts are intermeshed with, and overlap each other for providing a kneading, massaging or churning action to the slurry in a way which minimizes the opportunity for slurry to clog or become trapped in the device.

While a particular embedment roll device has been shown and described, it will be appreciated by those skilled in the art that changes and modifications may be made thereto without departing from the invention in its broader aspects and as set forth in the following claims.

What is claimed is:

1. An embedment device for use in a structural panel production line wherein a slurry is transported on a moving carrier relative to a support frame, and chopped fibers are deposited upon the slurry, said device comprising:

a first integrally formed elongate shaft rotatably secured to the support frame and having a first plurality of axially spaced disks axially fixed to said first shaft;

a second integrally formed elongate shaft rotatably secured to the support frame and having a second plurality of axially spaced disks axially fixed to said second shaft; and a groove defined between adjacent disks of said pluralities of disks on each of said first and second shafts and also defining an outer peripheral edge of each said shaft;

said first shaft being disposed relative to said second shaft to be horizontally aligned and so that said disks intermesh with each other, and wherein, when viewed from the side, peripheries of said first and second pluralities of disks overlap each other.

2. The device of claim 1 wherein said first plurality of axially spaced disks and said second plurality of axially spaced disks intermesh with each other only in regions of their respective outer peripheral edges.

3. The device of claim 1 wherein said first plurality of axially spaced disks and said second plurality of axially spaced disks intermesh with each other to create approximately ½ inch of overlap.

4. The device of claim 1 wherein a clearance between adjacent intermeshed disks of said first plurality of axially spaced disks and said second plurality of axially spaced disks is approximately 0.01-0.018 inches.

5. The device of claim 1 wherein said groove is approximately 1.4-1.8 inches deep.

6. The device of claim 1 wherein said shafts are oriented on said frame to be generally transverse to the direction of movement of slurry along the production line and to be generally parallel to each other and define a plane vertically displaced from and parallel to said moving carrier.

7. The device of claim 1 wherein said first plurality of disks are disposed relative to the frame to create a first trough pattern in the slurry for embedding the fibers therein, and said second plurality of disks are disposed relative to the frame to create a second trough pattern in the slurry, said second pattern being transversely offset from said first pattern.

8. The device of claim 1 wherein said shafts are configured to rotate in the same direction.

9. An embedment device for use in a structural panel production line wherein a slurry is transported on a moving carrier relative to a support frame, and chopped fibers are deposited upon the slurry, said device comprising:

a first roll secured to the support frame including a first shaft and a first plurality of axially spaced disks;

a second roll secured to the support frame including a second shaft and a second plurality of axially spaced disks; and a groove located between adjacent disks on said first and second rolls;

said first roll and said second roll arranged on the support frame such that said first plurality of axially spaced disks and said second plurality of axially spaced disks intermesh with each other.

10. The device of claim 9 wherein said first plurality of disks and said second plurality of disks intermesh with each other to create approximately ½ inch of overlap.

11. The device of claim 9 further including a first plurality of relatively small diameter disks fixed to said first shaft between said first plurality of axially spaced disks, and a second plurality of relatively small diameter disks fixed to said second shaft between said second plurality of axially spaced disks.

12. An embedment device for use in a structural panel production line wherein a slurry is transported on a moving carrier relative to a support frame, and chopped fibers are deposited upon the slurry, the device comprising:

a first roll rotatably secured to the support frame including a first shaft and a first plurality of axially spaced disks axially fixed to said first shaft;

a second roll rotatably secured to the support frame including a second shaft and a second plurality of axially spaced disks axially fixed to said second shaft; and a groove defined between adjacent disks on said first and second rolls and being an outer peripheral edge of said shaft, said groove being approximately 1.4-1.8 inches deep;

said first roll being disposed relative to said second roll to be horizontally aligned and so that said first plurality of axially spaced disks and said second plurality of axially spaced disks intermesh with each other approximately twice a distance of embedment of the disks into the slurry.

13. The device of claim 12 wherein said first plurality of axially spaced disks and said second plurality of axially spaced disks are integrally formed on their respective shafts.

14. The device of claim 12 wherein a clearance between adjacent intermeshed disks of said first plurality of axially spaced disks and said second plurality of axially spaced disks is approximately 0.01-0.018 inches.

15. The device of claim 12 wherein said first plurality of disks and said second plurality of disks intermesh with each other to create approximately ½ inch of overlap.

16. The device of claim 12 further including a first plurality of relatively small diameter disks fixed to said first shaft in between said first plurality of axially spaced disks, and a second plurality of relatively small diameter disks fixed to said second shaft in between said second plurality of axially spaced disks.

* * * * *